US012415699B2

(12) United States Patent
Kalaiselvan et al.

(10) Patent No.: US 12,415,699 B2
(45) Date of Patent: Sep. 16, 2025

(54) SINGLE MOVEABLE FEEDER UNIT FOR MULTI-FUNCTION DEVICES AND CORRESPONDING METHODS

(71) Applicant: XEROX CORPORATION

(72) Inventors: Prasanth Kalaiselvan, Mayiladuthurai (IN); Srinivasarao Bindana, Kakinada (IN); Naveenkumarreddy Challa, Medavakkam (IN); Manikandan Nagarajan, Tamilandu (IN)

(73) Assignee: Xerox Corporation, Norwalk, CT (US)

( * ) Notice: Subject to any disclaimer, the term of this patent is extended or adjusted under 35 U.S.C. 154(b) by 493 days.

(21) Appl. No.: 17/717,311

(22) Filed: Apr. 11, 2022

(65) Prior Publication Data

US 2023/0322516 A1 Oct. 12, 2023

(51) Int. Cl.

| | |
|---|---|
| ***B65H 3/06*** | (2006.01) |
| ***B65H 7/06*** | (2006.01) |
| ***B65H 29/14*** | (2006.01) |
| ***B65H 35/06*** | (2006.01) |

(52) U.S. Cl.

CPC ..... *B65H 29/14* (2013.01); *B65H 3/0638* (2013.01); *B65H 7/06* (2013.01); *B65H 35/06* (2013.01); *B65H 2601/11* (2013.01); *B65H 2801/06* (2013.01)

(58) Field of Classification Search

CPC . B65H 2301/515; B65H 2601/11; B65H 3/44

See application file for complete search history.

(56) References Cited

U.S. PATENT DOCUMENTS 7,891,655 B2 * 2/2011 Williams ..... B65H 3/0816 271/106

* cited by examiner

*Primary Examiner* — Howard J Sanders

(74) *Attorney, Agent, or Firm* — Fox Rothschild LLP

(57) ABSTRACT

The present disclosure discloses a moveable feeder assembly/unit for multi-function devices and corresponding retrieval and printing methods. Here, a multi-function device is disclosed. The multi-function device includes multiple trays. Each tray is configured to receive or store one or more media sheets, and further is positioned at a respective vertical height. The multi-function device further includes a single moveable feeder unit for all trays at the multi-function device. The single moveable feeder unit is configured to move across a plurality of positions to reposition itself proximate to a target tray of multiple trays, selected for printing operation.

14 Claims, 11 Drawing Sheets

SINGLE MOVEABLE FEEDER UNIT FOR MULTI-FUNCTION DEVICES AND CORRESPONDING METHODS

TECHNICAL FIELD

This disclosure relates generally to multi-function devices, and more particularly to a single moveable feeder unit for multi-function devices and corresponding methods

BACKGROUND

Multi-function devices are capable of performing a number of functions including those of email, fax, copying, printing, scanning or other imaging functions. Existing multi-function devices include multiple trays, with each of these trays being configured to accommodate a different type of media sheet, for example, a paper media sheet having different size or texture. Each of these trays is positioned at a respective vertical height, i.e., one above the other. Each tray has a separate feeder unit for retrieving sheets from that respective tray. For example, if a multi-function device has 3 trays, then 3 different feeder units are present in the multi-function device, where each feeder unit is dedicated to each tray. Each feeder unit retrieves media sheet from the associated tray. The retrieved media sheets are then used for printing by the multi-function device.

Here, multiple feeder units in the multi-function device increase the number of parts in the multi-function device leading to more assembly time and further makes the multi-function device/assembly more complex. This further requires high maintenance and unnecessarily increases service cost. Additionally, in paper jamming scenarios, multiple feeder units act as barrier to clear paper. Thus, there is a need for improvised feeder unit, methods, and systems.

SUMMARY

According to aspects illustrated herein, a multi-function device is disclosed. The multi-function device includes a plurality of trays. Each of the plurality of trays is configured to receive or store one or more media sheets. Each of the plurality of trays is configured to be positioned at a respective vertical height. The multi-function device further includes a single moveable feeder unit for the plurality of trays. The single moveable feeder unit is configured to move across a plurality of positions to reposition itself proximate to a target tray of the plurality of trays, selected for printing operation.

According to further aspects illustrated herein, a multi-function device is disclosed. The multi-function device includes a plurality of trays, wherein each of the plurality of trays is configured to store a media sheet stack. Further, each of the plurality of trays is positioned at a respective vertical height. The multi-function device further includes a single moveable feeder unit for the plurality of trays configured to move from a current position to a position proximate a target tray for retrieving one or more media sheets from the target tray. The multi-function device further includes a controller and a memory configured to store a plurality of instructions. The plurality of instructions, upon execution by the controller causes the controller to: receive a request for printing a document, wherein the request includes at least: a media size, a media type, and a tray and identify the target tray of the plurality of trays, to be used for printing the document, based on the request. The plurality of instructions, upon execution by the controller further causes the controller: to move the single moveable feeder unit from the current position to the position proximate the target tray for retrieving one or more media sheets from the target tray and to print the document using the one or more retrieved media sheets present in the target tray, resulting a print output.

According to furthermore aspects illustrated herein, a method for printing at a multi-function device including a plurality of trays is disclosed. The method includes receiving a request for printing a document, wherein the request includes at least: a media size, a media type, and a tray. Then, a target tray of the plurality of trays, to be used for printing the document is identified, based on the request. Thereafter, a single feeder unit is moved from a current position to a position proximate to the target tray for retrieving one or more media sheets from the target tray. Finally, the document is printed using the one or more retrieved media sheets present in the target tray, resulting a print output.

Other and further aspects and features of the disclosure will be evident from reading the following detailed description of the embodiments, which are intended to illustrate, not limit, the present disclosure.

BRIEF DESCRIPTION OF THE DRAWINGS

The illustrated embodiments of the subject matter will be best understood by reference to the drawings, wherein like parts are designated by like numerals throughout. The following description is intended only by way of example, and simply illustrates certain selected embodiments of devices, systems, and processes that are consistent with the subject matter as claimed herein.

DETAILED DESCRIPTION

Figure 1C:
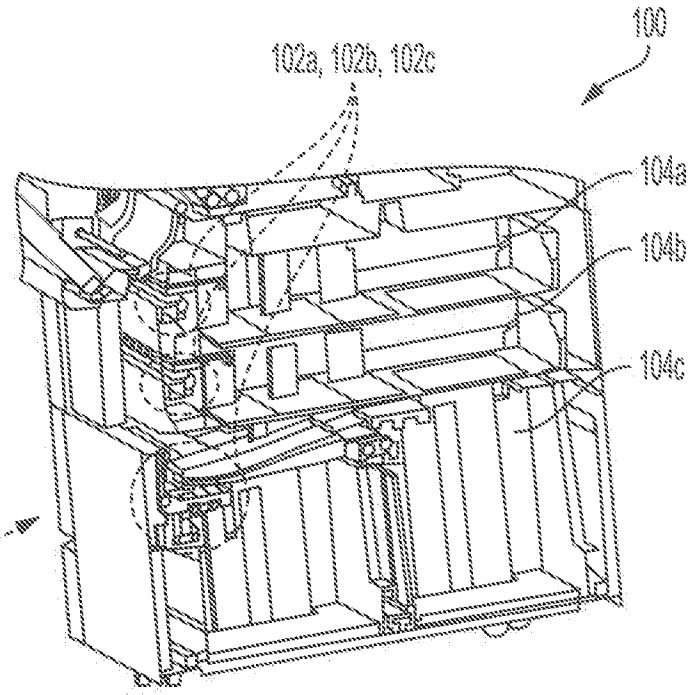
FIG. 1C PRIOR ART
FIGS. 1A-1C (Prior Art) illustrate different views of an existing multi-function device.

The following detailed description is made with reference to the figures. Some of the embodiments are described to illustrate the disclosure, not to limit its scope, which is defined by the claims. Those of ordinary skill in the art will recognize a number of equivalent variations in the description that follows.

Non-Limiting Definitions

Definitions of one or more terms that will be used in this disclosure are described below without limitations. For a person skilled in the art, it is understood that the definitions are provided just for the sake of clarity and are intended to include more examples than just provided below. In various embodiments of the present disclosure, definitions of one or more terms that will be used in the document are provided below.

The term "multi-function device" refers to a single device or a combination of multiple devices configured to perform one or more functions such as, but not limited to, scanning, printing, copying, imaging, or the like. The multi-function device includes software, hardware, firmware, or a combination thereof. In context of the current disclosure, the multi-function device includes a single moveable feeder unit such that it is moveable across all trays at the multi-function device.

The "single moveable feeder unit" refers to a unit attached to all trays at the multi-function device and further includes one or more components (discussed below in detail) to move the single moveable feeder unit across the trays at the multi-function device for retrieving one or more media sheets. The single moveable feeder unit is moveable based on a command from the multi-function device or based on an input from a user or admin user. By default, the single moveable feeder unit is set at a pre-defined tray in a pre-defined position at the multi-function device.

The term "plurality of trays" includes different trays at the multi-function device. Each tray includes one or more media sheets for use at the multi-function device. Each tray may include same type of media sheet or may include different media sheets or a combination thereof. For example, a tray named as tray 1 may include A4 sheets and a tray named as tray 2 may include A3 sheets.

The term "pre-defined tray" refers to a default tray where the single moveable feeder unit is set. For example, the pre-defined tray can be tray 1 at the multi-function device. The "target tray" refers to a tray to be used for printing operation.

The term "user" can be any user who submits a document for printing at the multi-function device.

The term "document" refers to any document submitted for printing by the user. The document includes one or more pages including content in the form of text, image, graphics, or a combination thereof. The document can be in the form of digital document.

The term "computing device" refers to a device that a user typically uses for his day-to-day work, submitting print commands and other purposes. Examples of the computing device include, but are not limited to, a personal computer, a desktop, a laptop, a mobile phone, a tablet, a Personal Digital Assistant (PDA), a smart-phone or any other device capable of data communication and/or print submission. The computing device includes a print driver application that allows the user to submit documents for printing, one or more print parameters, and so on.

Overview

Figure 1A:
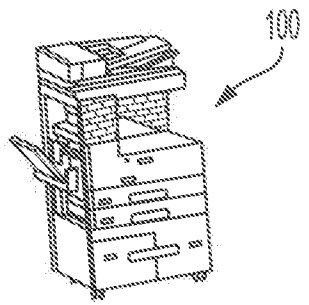
FIG. 1A PRIOR ART
Figure 1B:
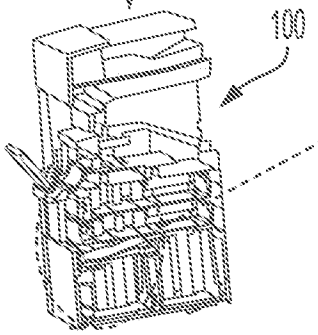
FIG. 1B PRIOR ART

Existing multi-function device 100 as shown in FIGS. 1A-1C include multiple different trays such as 104*a*, 104*b*, 104*c* (collectively 104), each tray 104 is configured to accommodate a different type of media sheet, for example, a paper media sheet. Each of the trays 104 is positioned at a respective vertical height, i.e., one above the other. Further, the existing multi-function device 100 includes a separate feeder unit (102*a*, 102*b*, and 102*c*, collectively 102) for each tray 104 for retrieving media sheet from the respective tray. Referring to FIGS. 1A-1C, different views of an existing multi-function device are illustrated. FIG. 1A illustrates a perspective view of the multi-function device 100. FIG. 1B illustrates a sectional view of the multi-function device 100, while FIG. 1C illustrates a magnified view of the sectional view (of FIG. 1B) of the multi-function device 100. As clearly seen in FIG. 1C, the multi-function device 100 includes three trays 104*b*, 104*b*, 104*c* positioned one above the other. The multi-function device 100 includes three moveable feeder units 102*a*, 102*b*, 102*c* dedicated for respective trays such as 104*a*, 104*b*, 104*c*. The feeder units 104 are positioned in proximity to a respective tray of the three trays 104*a*, 104*b*, 104*c*. The position of each feeder units such as 102*a*, 102*b*, 102*c* is fixed with respect to the three trays 104*a*, 104*b* 104*c* and each feeder unit 102*a*, 102*b*, 102*c* retrieves media sheets from the respective tray. In light of the above-mentioned problems with the multiple feeder units 102*a*, 102*b*, 102*c*, the present disclosure proposes a new single moveable feeder unit.

The present disclosure proposes a new feeder unit for multi-function devices and associated retrieval and printing methods. Specifically, the disclosure proposes a single moveable feeder unit for multiple trays at the multi-function device. The single moveable feeder unit decreases the total number of parts in the multi-function device, makes the multi-function device a light-weight machine, and overall, a simple machine to handle. The proposed unit further reduces assembly time and service cost for later stages.

The single moveable feeder unit is moveable across all trays at the multi-function for retrieving one or more media sheets from a target/desired tray. Based on a print request from a user, the single moveable feeder unit is moved from a current tray to a target tray for retrieving one or more media sheets for printing the document included in the request. This way, printing is completed using the new single moveable feeder unit. Once print operation is complete, the single moveable feeder unit is moved back to a pre-defined tray at the pre-defined position. The feeder unit further provides an easy paper jam clearance mechanism.

Exemplary Environment

Figure 2A:
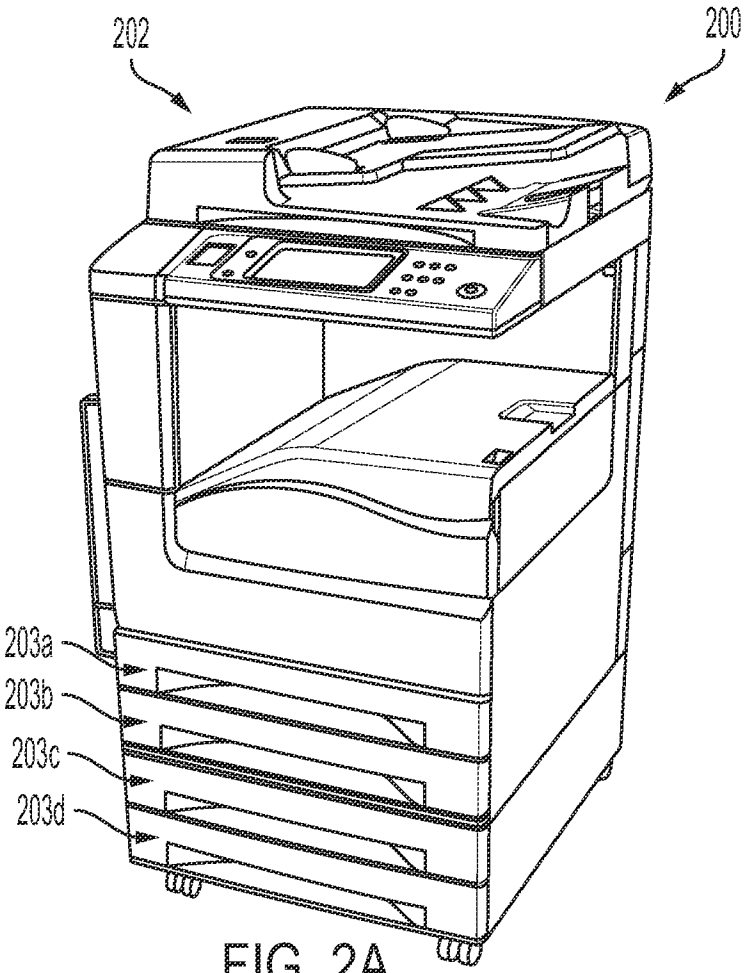
FIG. 2A illustrates an exemplary multi-function device in which various embodiments of the disclosure can be practiced, in accordance with some embodiments of the present disclosure.

FIG. 2A illustrates an exemplary environment 200 in which various embodiments of the disclosure can be practiced. The environment 200 is shown to include a multi-function device 202 but the environment 200 can include a printer, a multi-function printer or any device with printing capabilities. The multi-function device 202 performs one or more functions such as, but not limited to, scanning, printing, copying, imaging, faxing, form filling, or the like. The multi-function device 202 can be a home multi-function device, an office multi-function device or any other kind of multi-function device without limiting the scope of the disclosure. Typically, the multi-function device 202 is used by users for printing one or more documents. The documents can have one or more pages further having content in the form of text, image, graphics, or a combination thereof. The multi-function device 202 includes multiple trays 203*a*, 203*b*, 203*c*, 203*d*, collectively 203.

The trays 203 as shown may support all media types. Alternatively, the trays 203 may support specific media types and/or media sizes. The trays 203 may include same media types and/or sizes or may include different media types and/or sizes. For example, the trays 203*a* and 203*b* may include A4 media type and the tray 203*c* may include A3 media type, and the tray 203*d* may include special media such as glossy media. In another example, the trays 203*a*, 203*b* and 203*c* may include A4 media but of various sizes, and the tray 203*d* may include A3 media. In some implementations, any of the trays 203*a*, 203*b*, 203*c*, and 203*d* may be a dedicated tray in context of media sizes. For example, the tray 203*b* may support media size 216×279 mm but other trays such as 203*a*, 203*c* and 203*d* may support all media types and/or sizes. These are few examples, but other variations as known as or later developed may be implemented without deviating the scope of the disclosure.

Further, the multi-function device 202 is shown to include four trays 203 but the multi-function device 202 can have any number of trays as required for implementing the present disclosure. The trays 203 receive or store one or more media sheets, also referred to as stack of sheets. Each of the trays is positioned at a respective vertical height.

In context of the current disclosure, the multi-function device 202 includes a single moveable feeder unit for all trays at the multi-function device 202. The single moveable feeder unit is configured to move across a plurality of positions to reposition itself proximate to a target tray of multiple trays, selected for printing operation. Specifically, the single feeder unit moves across a plurality of positions to reposition itself proximate to a target tray from where one or more media sheets are to be retrieved and used for printing. The feeder unit is moveable vertically up or down across the multiple trays at the multi-function device 202. By default, the moveable feeder unit is preset at a pre-defined tray such as tray 1 or tray with A4 media sheets, at the multi-function device 202 in a pre-defined position such as unfeed position. The moveable feeder unit is associated or attached to at least one frame using one or more screws. Further, the moveable feeder unit may include at least one bearing, to allow the moveable feeder unit to move relative to the trays of the multi-function device 202. The feeder unit is configurable to move between unfeed and feed positions based on a command from the multi-function device 202.

In operation, the single feeder unit moves from a current tray to a target tray i.e., a tray to be used for printing operation. Once moved to the target tray, the feeder unit is rotated from the unfeed position to the feed position to retrieve one or more media sheets from the target tray for printing. This way, printing the document is completed at the multi-function device 202. The feeder unit is rotated back to unfeed position. Once set, the feeder unit is moved back to the pre-defined tray/default tray in default position i.e., unfeed position. In addition to this, the feeder unit includes a paper jam clearance mechanism. The feeder unit includes one or more components for moving the feeder unit vertically up and/or down across the trays at the multi-function device 202 and more structural, functional and implementation details will be discussed below in detail.

The multi-function device 202 may include a sensor which helps to locate and position the single moveable feeder unit in proximity to a particular tray from where the media sheets are required to be retrieved. Further, in case of jamming of media sheet, a blade is provided to cut the jammed media sheet, and free the single moveable feeder unit.

Figure 2C:
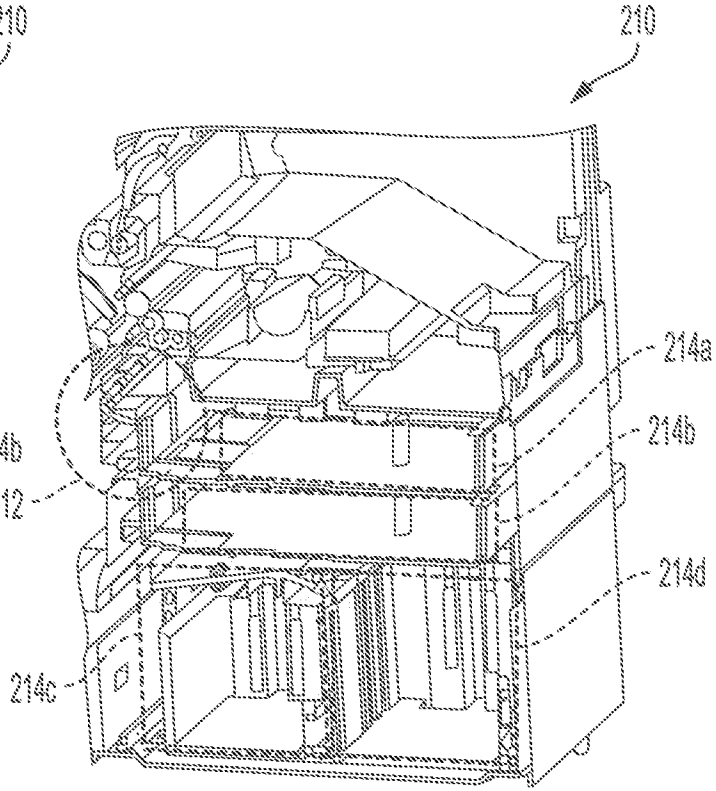
FIGS. 2B-2C illustrate a front view and a perspective view, respectively, of a multi-function device, in accordance with some embodiments of the present disclosure.
Figure 2B:
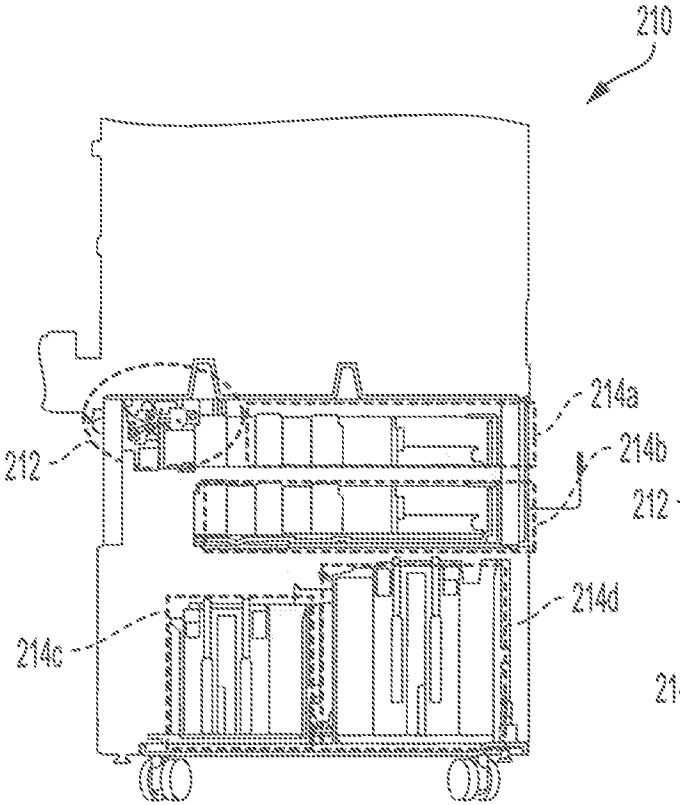

FIGS. 2B-2C, a front view and a perspective view, respectively of the multi-function device 210 are illustrated. The multi-function device 210 includes multiple trays as shown in FIGS. 2B-2C. As clearly seen in these figures, the multi-function device 210 includes four trays such as 214*a*, 214*b*, 214*c*, 214*d*, collectively trays 214. Each tray 214 is configured to store one or more media sheets, for example a media sheet stack. For example, the media sheets may be paper media sheets. Further, each tray 214 may be configured to store a stack of different type of media sheets, i.e. A4 size media sheets, or A3 size media sheets, A2 size media sheets, etc. Each tray 214 may be configured to be positioned at a respective vertical height relative to each other. For example, as shown in FIGS. 2B-2C, the trays 214 are positioned vertically one above the other.

As further seen in FIGS. 2B-2C and in context of the current disclosure, the multi-function device 210 further include a single moveable feeder unit 212 configured to retrieve one or more media sheets from each of trays 214. The single moveable feeder unit 212 is configured to move across a plurality of positions to reposition itself proximate to a tray of the plurality of trays 214 from where the single moveable feeder unit 212 is to retrieve the media sheet for printing purpose. In other words, the single moveable feeder unit 212 moves vertically upwards or vertically downwards to position itself proximate to a tray from where media sheet(s) is to be retrieved. The movement of the single moveable feeder unit 212 is further explained in detail in conjunction with FIG. 3.

Figure 3:
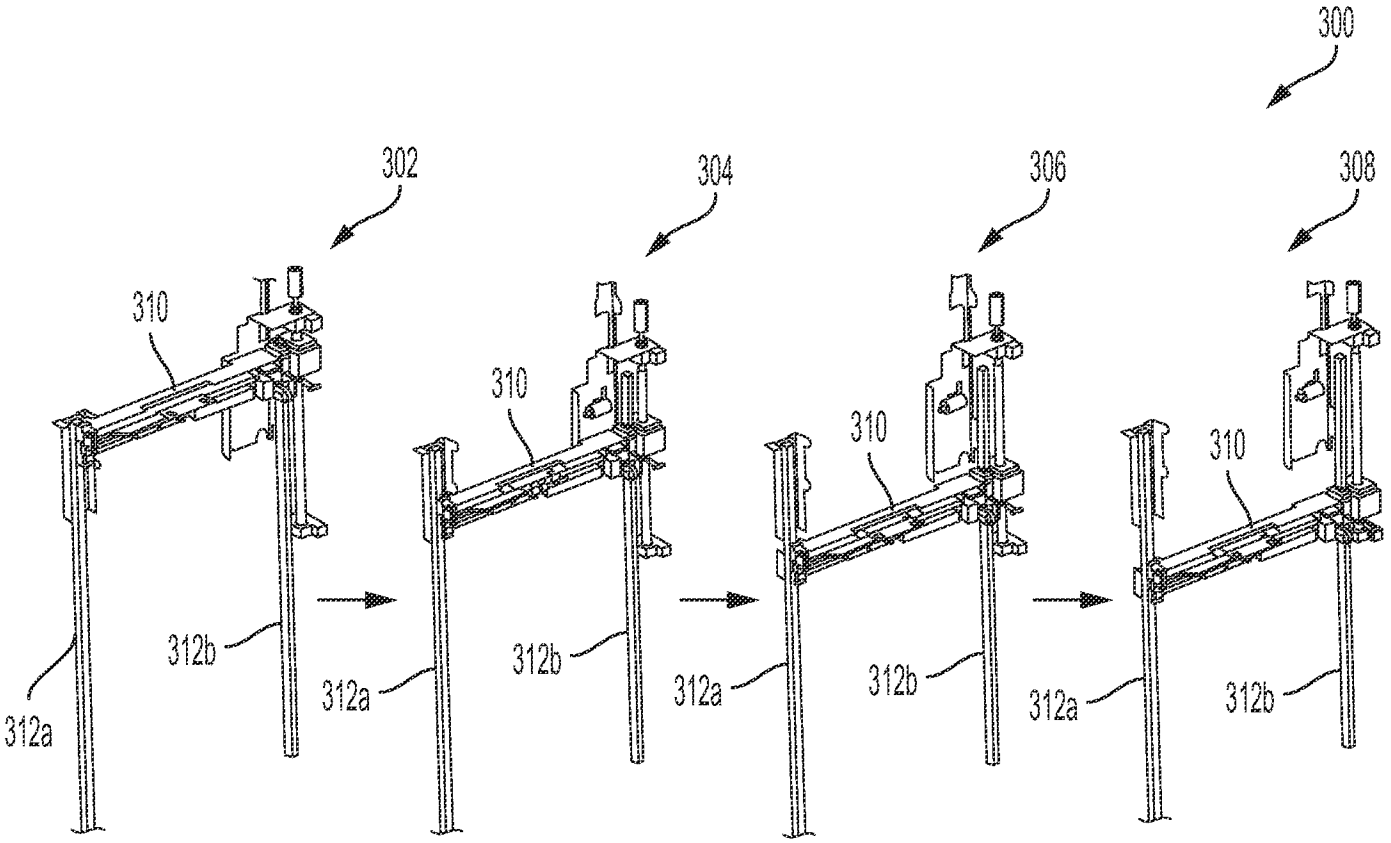
FIG. 3 is a flow diagram of a process of the movement of a single moveable feeder unit of the multi-function device (of FIGS. 2A-2C) across a plurality of trays, in accordance with some embodiments of the present disclosure.

Referring further to FIG. 3, a flow diagram of a process 300 of the movement of a single moveable feeder unit 310 of a multi-function device across the plurality of positions is illustrated. It is considered here that the multi-function device includes four trays positioned at a respective vertical height, i.e., vertically one above the other. As such, in order to retrieve media sheets from each of the plurality of the four trays, the single moveable feeder unit 310 is configured to move across the plurality of positions to reposition itself proximate to a tray from where the single moveable feeder unit 310 is to retrieve the media sheet.

At 302, the single moveable feeder unit 310 is at a first position, i.e., at vertically topmost position with respect to the multi-function device. In the first position, the single moveable feeder unit 310 is positioned proximate to a first tray (i.e., topmost tray) of the four trays. In the first position, the single moveable feeder unit 310 retrieves media sheets from the first tray of the four trays.

At 304, the single moveable feeder unit 310 is moved further and is located at a second position, i.e., at a vertically second-topmost position with respect to the multi-function device. In the second position, the single moveable feeder unit 310 is repositioned proximate to a second tray (second topmost) of the four trays, by moving vertically from the first position to the second position. In the second position, the single moveable feeder unit 310 retrieves media sheets from the second tray of the four trays.

At 306, the single moveable feeder unit 310 is moved down vertically and is located at a third position, i.e., at a vertically second-bottommost position with respect to the multi-function device. In the third position, the single moveable feeder unit 310 has further repositioned itself proximate to a third tray (i.e., vertically second-bottommost tray) of the four trays, by moving vertically from the second position to the third position. In the third position, the single moveable feeder unit 310 retrieves media sheets from the third tray of the four trays.

At 308, the single moveable feeder unit 310 is at a fourth position, i.e., at a vertically bottommost position with respect to the multi-function device. In the fourth position, the single moveable feeder unit 310 has further repositioned itself proximate to a fourth tray (i.e., vertically bottommost position tray) of the four trays, by moving vertically from the third position to the fourth position. In the fourth position, the single moveable feeder unit 310 retrieves media sheets from the fourth tray of the four trays.

In order to move across the plurality of positions as discussed, the single moveable feeder unit 310 moves along at least one vertically oriented track. For example, as shown in FIG. 3, the single moveable feeder unit 310 is configured to engage with two tracks 312*a*, 312*b* and move across the plurality of positions along the two tracks 312*a*, 312*b*. Each of the two tracks 312*a*, 312*b* is oriented along an imaginary substantially vertical axis. This is further explained in conjunction with FIGS. 4A-4D.

Figure 4A:
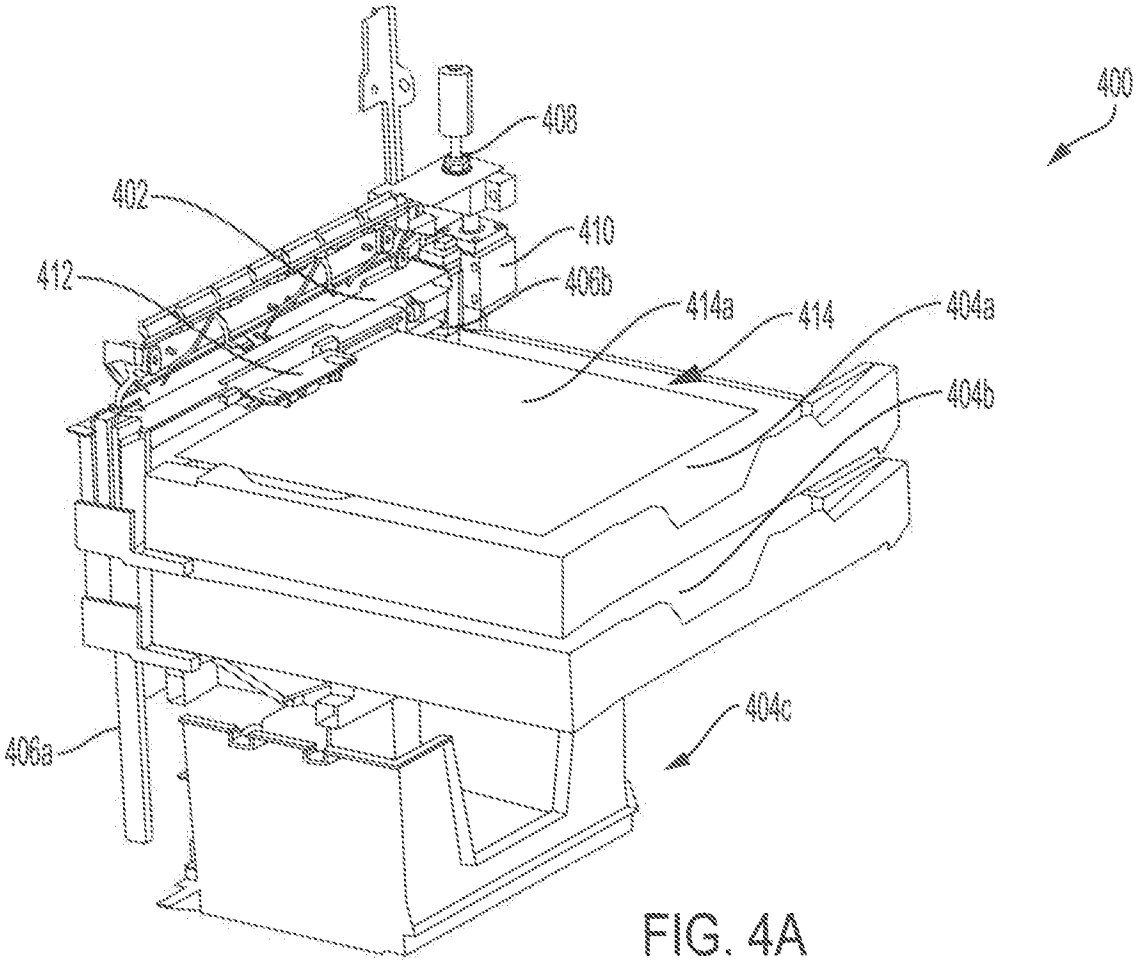
FIG. 4A illustrates a perspective view of a part of a multi-function device, in accordance with some embodiments of the present disclosure.

Referring now to FIG. 4A, a perspective view of a part of a multi-function device 400 (corresponding to the multi-function device 210) is illustrated. The multi-function device 400 includes a single moveable feeder unit 402 (corresponding to the single moveable feeder unit). As shown, the multi-function device 400 includes three trays 404*a*, 404*b*, 404*c*. Each of the three trays 404*a*, 404*b*, 404*b* is configured to store a media sheet stack. Further, each of the three trays 404*a*, 404*b*, 404*c* is positioned at a respective vertical height, i.e., vertically one above the other. The single moveable feeder unit 402 is configured to retrieve one or more media sheets from each of the three trays 404*a*, 404*b*, 404*c*. The single moveable feeder unit 402 is further configured to move across three positions corresponding to the three trays 404*a*, 404*b*, 404*c*, to reposition itself proximate to a tray of the three trays 404*a*, 404*b*, 404*c* from where the single moveable feeder unit 402 is to retrieve the media sheets.

As mentioned above, the multi-function device 400 includes at least one track oriented along a substantially vertical axis. In an example, each of the at least one track may be rigidly fixed to the multi-function device 400, and may be made of a rigid material like, including but not limited to, a metal, an alloy, a plastic, etc. In implementation of FIG. 4A, the multi-function device 400 include two tracks 406*a*, 406*b*. Each of the two tracks 406*a*, 406*b* is rigidly fixed to the multi-function device 400, and oriented along the substantially vertical axis. The single moveable feeder unit 402 is configured to engage with at least one of the two tracks 406*a*, 406*b* and to move across the plurality of positions along the at least one of the two tracks 406*a*, 406*b*.

In order to move the single feeder unit across multiple different positions, the multi-function device 400 includes a drive system. As shown in FIG. 4A, the drive system includes a vertically oriented lead screw 408. The lead screw 408 is attached to the multi-function device 400 and oriented parallel to the substantially vertical axis. The drive system further includes an engaging member (not visible in FIG. 4A) attached to the single moveable feeder unit 402 and configured to engage with the lead screw 408. The drive system includes a first motor 410. In some embodiments, the first motor 410 may be attached to the single moveable feeder unit 402. The first motor 410 may be coupled to the engaging member and configured to rotate the engaging member to thereby cause movement of the engaging member and the single moveable feeder unit 402 along the lead screw 408. The first motor 410, for example, may be an electric motor (a direct current motor (DC) or an alternating current (AC) motor).

By way of an example, the lead screw 408 may be rigidly to the multi-function device 400 and oriented along a substantially vertically axis. The lead screw 408 may include threads formed along its length. The engaging member, for example, may include a nut having threads (along an inner surface) matching with the threads of the lead screw 408. As such, the engaging member may be configured to threadably engage with the lead screw 408, and further configured to move along the length of the lead screw 408 by way of rotation about its axis. At least one bearing, at least one bearing bushing, and at least one guide rail may be provided for allowing engaging and rotation of the engaging member with the lead screw 408.

The first motor 410 may be fixedly attached to the single moveable feeder unit 402. Further, the engaging member may be fixedly attached to the first motor 410. As such, the first motor 410 may be configured to rotate the engaging member about an axis coincident with the central axis of the lead screw 408. By way of rotating the engaging member, the first motor 410 may therefore cause movement of the engaging member as well as of the single moveable feeder unit 402 along the length of the lead screw 408. As will be understood, rotation of the engaging member in one direction (i.e., one of the clockwise or anticlockwise direction) may cause movement of the engaging member and the single moveable feeder unit 402 vertically upwards, while rotation of the engaging member in the opposite direction (i.e., the other of the clockwise or anticlockwise direction) may cause movement of the engaging member and the single moveable feeder unit 402 vertically downwards.

The single moveable feeder unit 402 further includes a folding feed roller 412 to retrieve the media sheets from the tray and feed the media sheets to a printing section/engine (not shown in FIG. 4A) of the multi-function device 400. The folding feed roller 412 may be configurable between a feed position and an un-feed position. Once the single moveable feeder unit 402 is at a desired position proximate to a tray from where the media sheets is to be retrieved, the folding feed roller 412 may be configured into the feed position. In the feed position, the folding feed roller 412 may remove a top media sheet 414*a* from the media sheet stack 414 present in the tray. Once the retrieving of the media sheet(s) 414*a* is complete and the single moveable feeder unit 402 is required to travel to a different position proximate to a different tray, the folding feed roller 412 may be configured into the un-feed position. In some embodiments, the folding feed roller 412 may be configurable between the feed position and the un-feed position by pivotably rotating about a horizontal axis parallel to the length of the single moveable feeder unit 402. This is further explained in detail in conjunction with FIGS. 5A-5B.

Figures 4B, 4C, 4D:
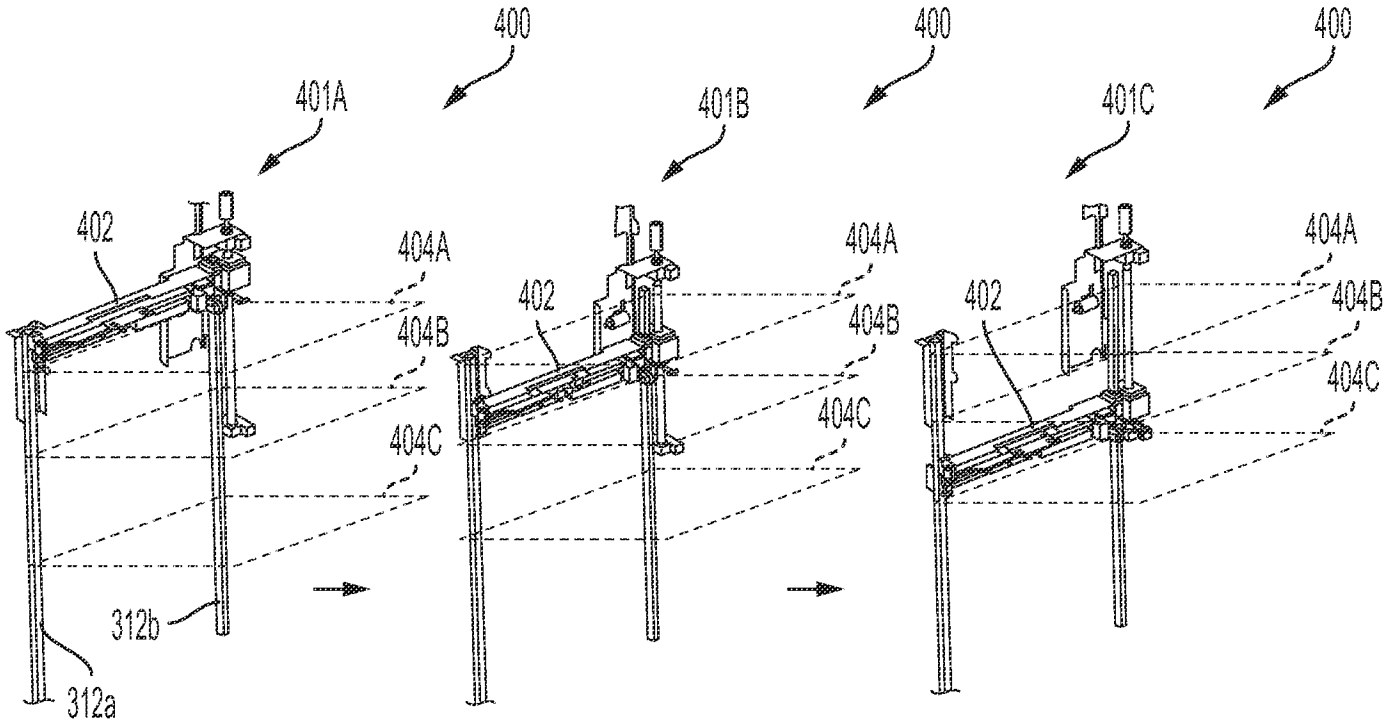
FIGS. 4B-4D illustrate perspective views of a part of the multi-function device with the single moveable feeder unit at different positions corresponding to the three trays, respectively, in accordance with some embodiments of the present disclosure.

Referring now to FIGS. 4B-4D, perspective views 401A, 401B, 401C of a part of the multi-function device 400 with the single moveable feeder unit 402 at different positions corresponding to the three trays 404*a*, 404*b*, 404*c*, respectively are illustrated in accordance with some embodiments of the present disclosure. As shown in FIG. 4B, the single moveable feeder unit 402 is at the first position, i.e., at vertically topmost position with respect to the multi-function device. In the first position, the single moveable feeder unit 402 is positioned proximate to the tray 404*a* (represented by dotted lines). As such, in this position, the single moveable feeder unit 402 retrieves media sheets from the tray 404*a*. Further, as shown in FIG. 4C, the single moveable feeder unit 402 is moved from the first position and is located at the second position, i.e., at a vertically middle position with respect to the multi-function device. In the second position, the single moveable feeder unit 402 is repositioned proximate to the tray 404*b* (represented by dotted lines), by moving vertically from the first position to the second position. In the second position, the single moveable feeder unit 402 retrieves media sheets from the tray 404*b*. Further, as shown in FIG. 4D, the single moveable feeder unit 402 is further moved down vertically and is located at the third position, i.e., at a vertically bottommost position with respect to the multi-function device. In the third position, the single moveable feeder unit 402 has further repositioned itself proximate to the tray 404*c* (represented by dotted lines), by moving vertically from the second position to the third position. In the third position, the single moveable feeder unit 402 retrieves media sheets from the tray 404*c*.

Figure 5A:
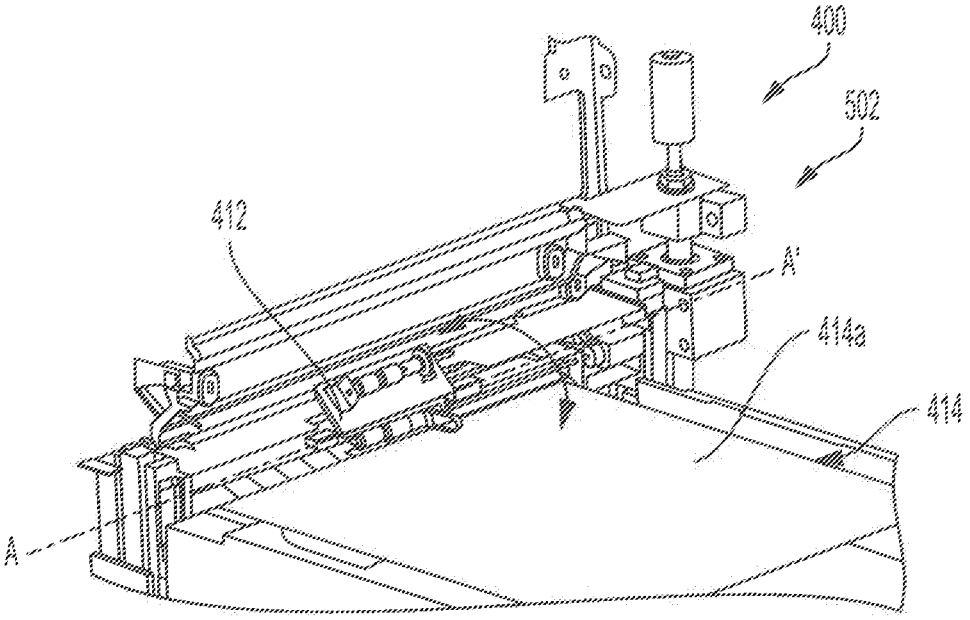
FIGS. 5A-5B illustrate perspective views of a part of the multi-function device with the folding feed roller configured in the un-feed position and the feed position, respectively, in accordance with some embodiments of the present disclosure.
Figure 5B:
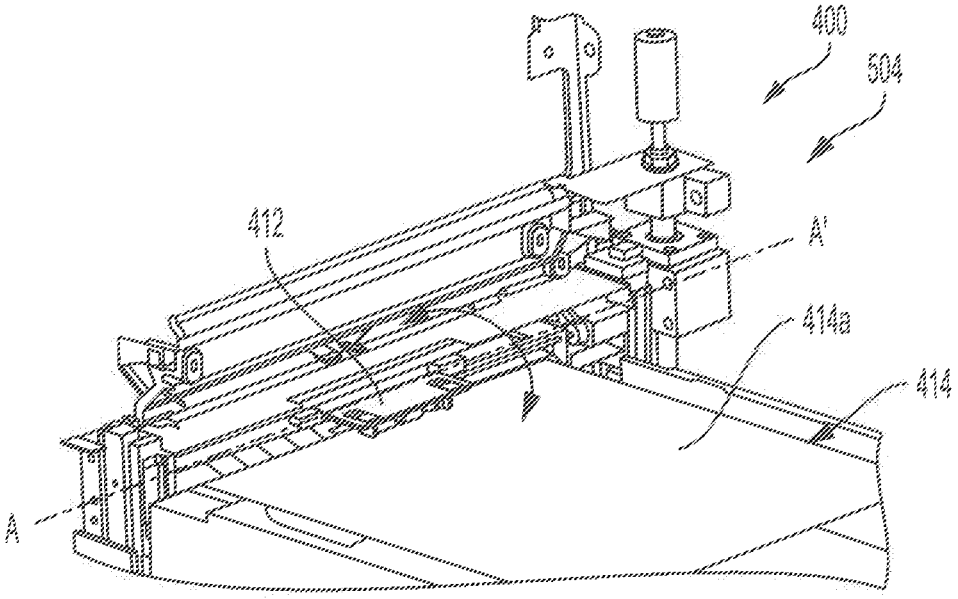

Referring now to FIGS. 5A-5B, perspective views 502, 504 of a part of the multi-function device 400 with the folding feed roller 412 (of FIG. 4A) configured in the un-feed position and the feed position, respectively are illustrated. As shown in FIG. 5A, the folding feed roller 412 is configured in the un-feed position. In the un-feed position, the folding feed roller 412 is aligned away from the media sheet stack 414. For example, the folding feed roller 412 includes one or more rollers. These one or more rollers, upon contacting the top media sheet 414*a* of the media sheet stack 414, is configured to rotate and to pull and remove the top media sheet from the media sheet stack 414. In an example, the one or more rollers of the folding feed roller 412 may have a high friction surface which is capable of pull and remove the top media sheet from the media sheet stack 414. In the un-feed position, the folding feed roller 412 is aligned away from the media sheet stack 414, the folding feed roller 412 is not able to remove the top media sheet from the media sheet stack 414.

As shown in FIG. 5B, the folding feed roller 412 is configured in the feed position. Once the single moveable feeder unit 402 is at a desired position proximate to the tray from where the media sheet is to be retrieved, the folding feed roller 412 is configured into the feed position. In the feed position, the folding feed roller 412 is configured to remove the top media sheet 414*a* from the media sheet stack 414 present in the tray. The one or more rollers may contact the top media sheet 414*a* of the media sheet stack 414. Upon contacting, the one or more rollers rotate to pull and remove the top media sheet 414*a* from the media sheet stack 414. In order to be configured in the feed position (of FIG. 5B) from the un-feed position (of FIG. 5A), the folding feed roller 412 may pivotably rotate about a horizontal axis A-A' parallel to the length of the single moveable feeder unit.

In some implementations, the folding feed roller 412 may be powered by a solenoid to pivotably rotate about the horizontal axis A-A'. But in other implementations, the folding feed roller 412 may be powered by an alternate mechanism to cause the folding feed roller 412 to pivotably rotate about the horizontal axis A-A'.

Once retrieving of the media sheet(s) 414*a* is complete and the single moveable feeder unit 402 is required to travel to a different position proximate to a different tray, the folding feed roller 412 may be once again configured in the un-feed position. The folding feed roller 412 may be caused to pivotably rotated about the horizontal axis A-A' to reconfigure into the un-feed position. Once the retrieving of the media sheet is complete and the single moveable feeder unit 402 is required to travel to a different position, the folding feed roller 412 may be configured into the un-feed position, before the single moveable feeder unit 402 starts travelling to a different position. The un-feed position of the folding feed roller 412 may allow the single moveable feeder unit 402 to travel across the plurality of positions without any obstructions.

In some implementations and in function, a media sheet from the media sheet stack may get jammed in the single moveable feeder unit, for various reasons including disorienting of the media sheet, improper/incomplete removal of the media sheet, media sheet getting stuck, etc. The jamming of the media sheet may cause the single moveable feeder unit to get stuck at one position. Thus, it is required to clear the paper jammed stuck in the feeder unit. In such situations, the paper jam clearance mechanism is implemented. The paper jam clearance mechanism includes a blade configured to cut the media sheet when the media sheet is jammed in the single moveable feeder unit. This is further explained in conjunction with FIG. 6 and FIGS. 7A-7C.

Figure 6:
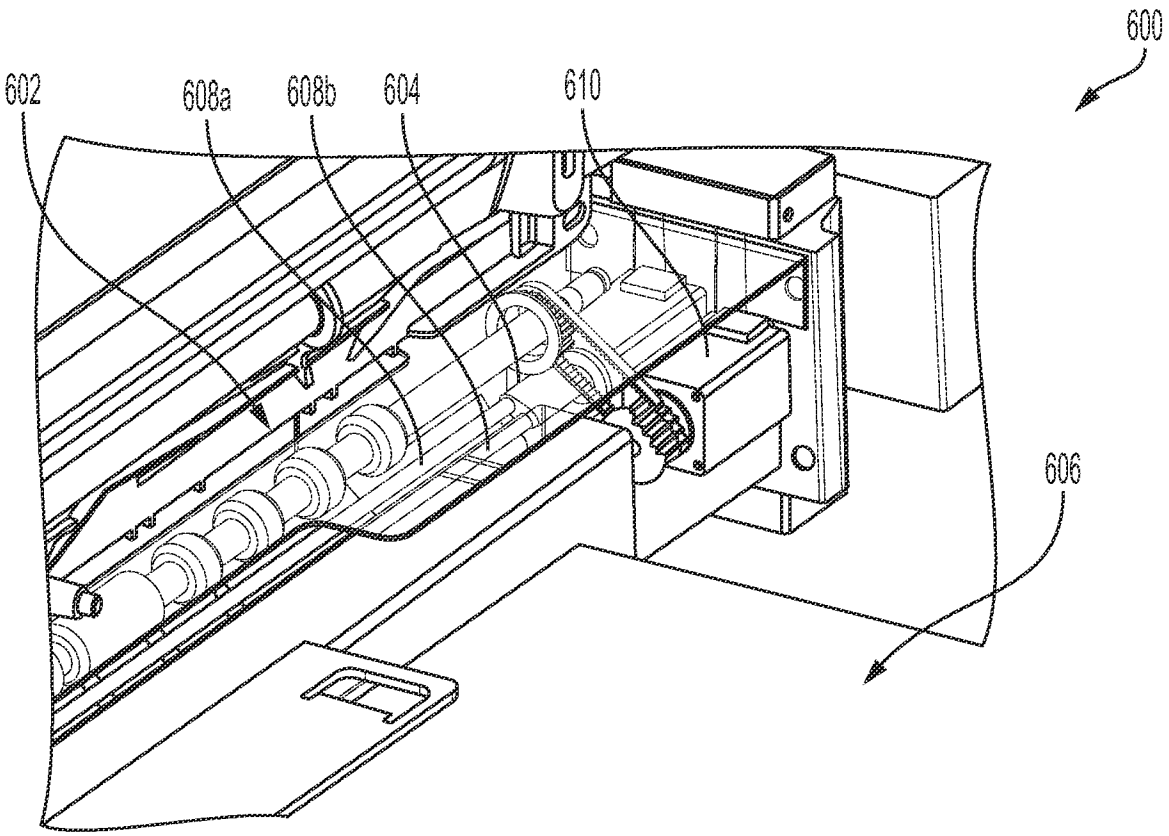
FIG. 6 illustrates a perspective view of a section of a multi-function device, in accordance with some embodiments of the present disclosure.

Referring further to FIG. 6, a perspective view of a section of a multi-function device 600 is shown. According to the view shown in FIG. 6, the single feeder unit of the multi-function device 600 is shown to include a blade. The blade 604 is configured to travel horizontally along a length of the single moveable feeder unit 602 to cut a media sheet 606 which may get jammed in the single moveable feeder unit 602. The length of the single moveable feeder unit 602 can be defined between a first end and a second end of the single moveable feeder unit 602. As will be understood, the length of the single moveable feeder unit 602 may be perpendicular to the substantially vertical axis (along which the at least one track is oriented).

For the blade 604 to travel along the length of the single moveable feeder unit 602, the single moveable feeder unit 602 further includes two shafts such as a guide/drive shaft 608*a* and a threaded shaft 608*b*. The threaded shaft 608*b* is aligned parallel to the length of the single moveable feeder unit 602. The blade 604 may be threadably engaged with the threaded shaft 608*b*. The blade 604 travels along the threaded shaft 608*b* upon rotation of the threaded shaft 608*b* about its central axis. To this end, the blade 604 further includes a threaded ring section formed into the blade 604 that may include threads matching the threads of the threaded shaft 608*b* and configured to engage with the threaded shaft 608*b*. As the threaded shaft 608*b* rotates about its central axis, the blade 604 is caused to move along the threaded shaft 608*b*.

In some implementations, the rotation of the threaded shaft 608*b* is powered by a second motor 610. The second motor 610 may be an electric motor (a direct current motor (DC) or an alternating current (AC) motor). Further, the second motor 610 may be mounted on and fixed to the single moveable feeder unit 602.

In some implementations, to cut the jammed media sheet, the blade 604 may perform a to-and-fro movement along the threaded shaft 608*b*. In other words, for example, the blade 604 may first travel from the first end to the second end of the single moveable feeder unit 602, and then travel back from the second end to the first end of the single moveable feeder unit 602. Here, rotation of the threaded shaft 608*b* (by the second motor 610) in one direction (i.e., clockwise, or anticlockwise direction) causes movement of the blade 604 from the first end to the second end of the single moveable feeder unit 602. Similarly, a rotation of the threaded shaft 608*b* (by the second motor 610) in an opposite direction (i.e., the other of the clockwise or anticlockwise direction) causes movement of the blade 604 from the second end to the first end of the single moveable feeder unit 602. The movement of the blade 604 is further explained in conjunction with FIGS. 7A-7C.

Figures 7A, 7B, 7C:
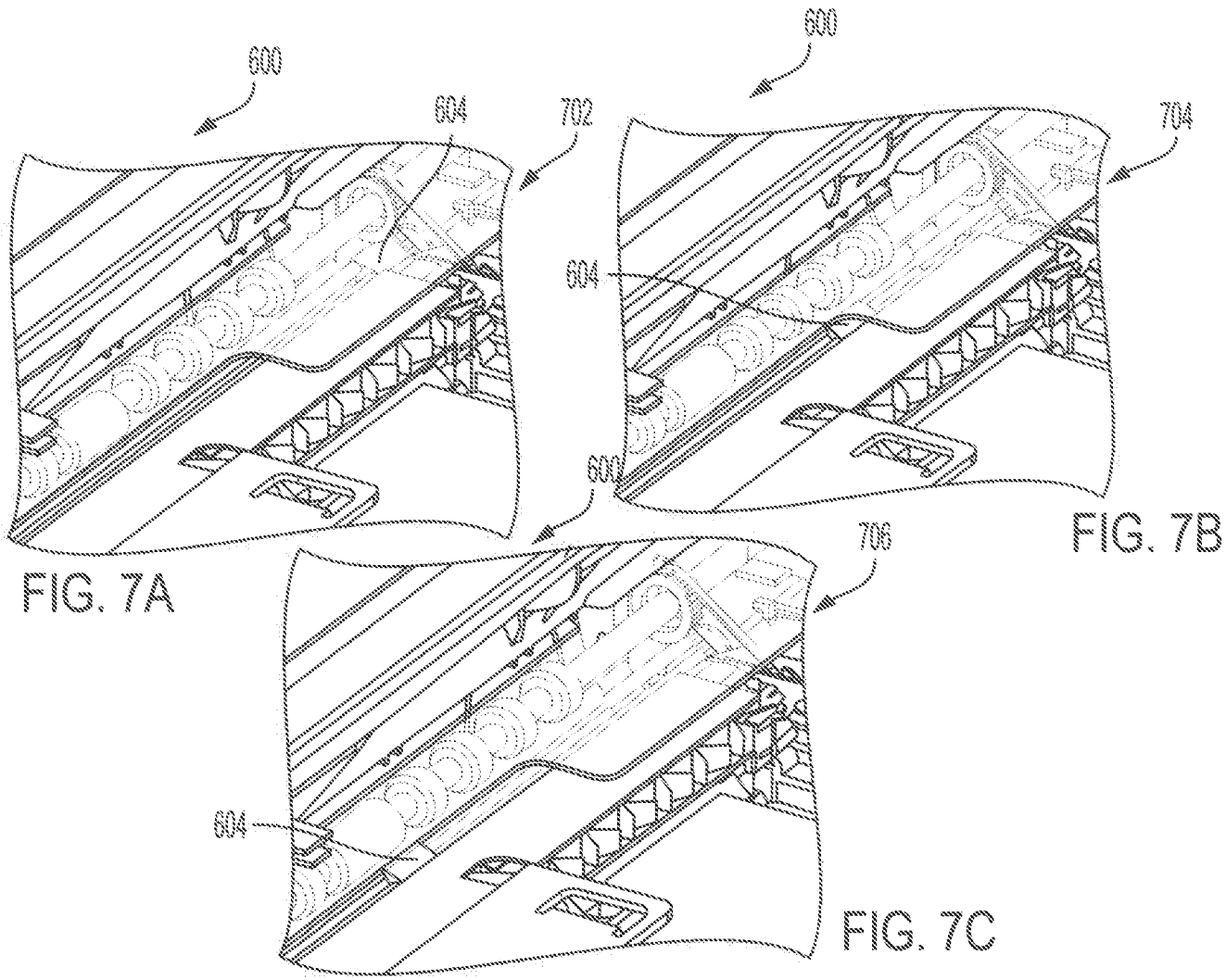
FIGS. 7A-7C illustrate perspective views of a part of the multi-function device with the blade at a first, a second, and a third position, respectively, in accordance with some embodiments of the present disclosure.

Referring now to FIGS. 7A-7C, perspective views 702, 704, 706 of a part of the multi-function device 600 with the blade 604 at a first, a second, and a third position, respectively are illustrated. As shown in FIG. 7A, the blade 604 is at the first position relative to the length of the single moveable feeder unit 602. As it can be seen further in FIG. 7A, at the first position, the blade 604 is near the first end of the single moveable feeder unit 602. In order to cut the jammed media sheet 606, the blade 604 starts travelling towards the second end of the single moveable feeder unit 602. As shown in FIG. 7B, the blade 604 is at the second position relative to the length of the single moveable feeder unit 602. As can be seen, at the second position, the blade 604 is somewhere in the middle of the first end and the second end of the single moveable feeder unit 602. As shown in FIG. 7C, the blade 604 is at the third position and is further moved from the first end of the single moveable feeder unit 602 and positioned yet nearer to the second end of the single moveable feeder unit 602, having completed the cutting of the jammed media sheet 606. Once cutting of the jammed media sheet 606 is complete, the blade 604 starts moving back towards the first end of the single feeder unit 602 and maintains its default/initial position i.e., as of FIG. 7A.

Figure 8:
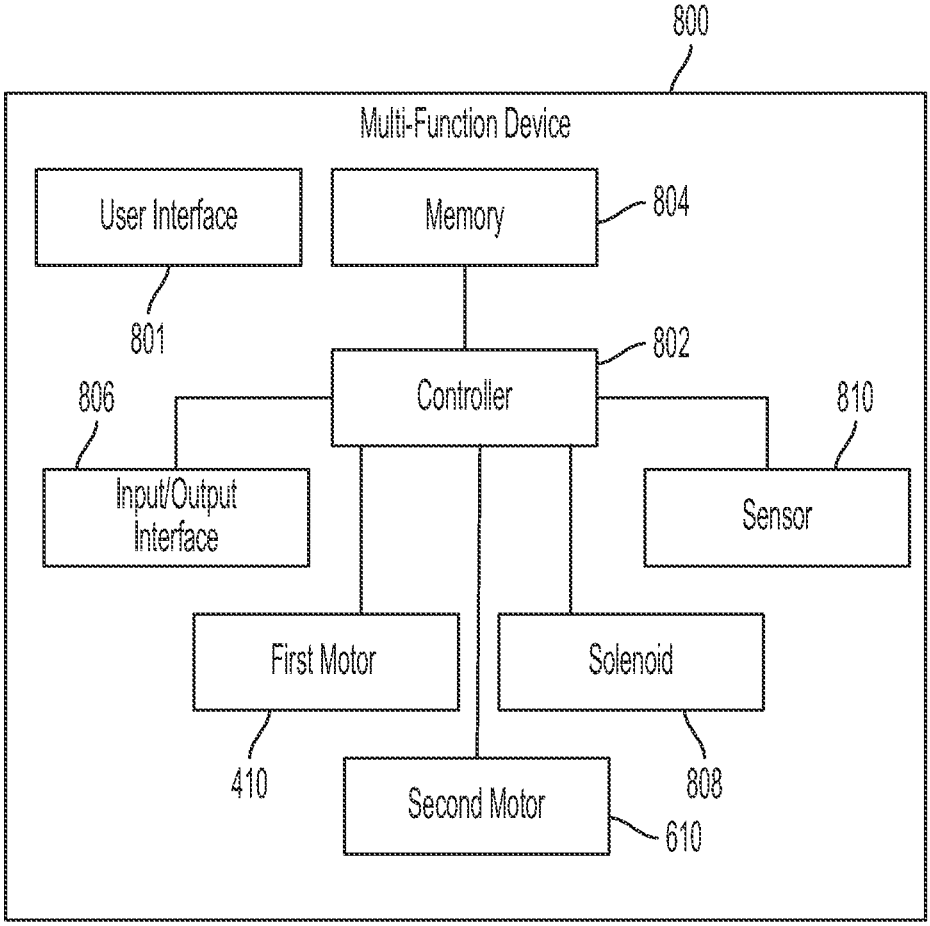
FIG. 8 is a block diagram of a multi-function device, in accordance with some embodiments of the present disclosure.

In some implementations, the multi-function device further includes at least one sensor, for example, the at least one sensor coupled to the first motor. The sensor is configured to detect a position of the single moveable feeder unit and provide a signal to the first motor to start or stop causing movement of the single moveable feeder unit along the lead screw to reposition the single moveable feeder unit. Referring now to FIG. 8, a block diagram of a multi-function device 800 is illustrated. Reference to other figures discussed above may be made while discussing FIG. 8. As shown, the multi-function device includes a single moveable feeder unit such as 402 (or feeder units shown in other figures) and the plurality of trays. Each tray may include a sensor, and further, the moveable feeder unit may also include one or more sensors. The multi-function device 800 further includes a user interface 801, a controller 802 and a memory 804. Furthermore, the multi-function device 800 may include an input/output interface 806 for input/output purpose, the first motor 410, the second motor 610, a solenoid 808, and a sensor 810. The print engine is in communication with the single moveable feeder 402 unit for receiving the retrieved sheets for printing content of the document.

The user interface 801 allows the user to input various details such as media details, user ID and other relevant details required for implementing the present disclosure. For example, the user interface 801 allows the user to perform various selection in context of the current disclosure such as media type, media size, media color, and so on. The user interface 801 may include one or more buttons, or a touch screen, or a keyboard, etc. to receive the inputs from the user. The input received from the user may include a media sheet from a target tray from the plurality of trays for retrieving the media sheet. The user interface 801 further displays various message/notification to the user as relevant for implementing the current disclosure.

The memory 804 stores all relevant information required for implementing the current disclosure. For example, the memory 804 stores a document for printing, trays IDs, media details, user IDs, number of sheets in respective trays or the like. The memory 804 further stores a plurality of controller executable instructions. The plurality of controller executable instructions, upon being executed by the controller 802, may cause the controller 802 to perform one or more operations required for implementing the current disclosure i.e., for moving the feeder unit from a current tray to a target tray for retrieving one or more media sheets for print operation. Any details stored in the memory 804 may be retrieved by the controller 802 as and when required for implementing the current disclosure. These are few examples, but the memory 804 may store other relevant details/information required for implementing the current disclosure.

In particular, the memory 804 is configured to store a plurality of instructions, wherein the plurality of instructions, upon execution by the controller, cause the controller to: receive a request for printing a document, wherein the request includes at least: a media size, a media type, and a tray; identify the target tray of the plurality of trays, to be used for printing the document, based on the request; move the single moveable feeder unit from the current position to the position proximate the target tray for retrieving one or more media sheets from the target tray; and print the document using the one or more retrieved media sheets present in the target tray, resulting a print output.

By default, the moveable feeder unit is set at a pre-defined tray i.e., tray 1 in a pre-defined position i.e., in unfeed position considering no print operation is being performed. In some implementations, the pre-defined tray can be the last tray i.e., such as tray 2, tray 3, tray 4 or tray 1 itself, used for print operation. The controller 802 manages the feeder unit such that the feeder unit moves up and/or down across different positions of the trays at the multi-function device. The feeder unit travels vertically up and down with the help of a lead screw mechanism. The lead screw mechanism is motor driven and is supported with a bearing, bearing bush, and guided by guide rail for vertical movement of the feeder unit as discussed above in detail. The sensor senses the position of the feeder unit and movement of the feeder unit across different positions of the trays at the multi-function device.

In some implementations, a sensor is provided on the feeder unit that is capable of sensing the position of the feeder unit and movement of the feeder unit relative to the trays of the multi-function device.

Further, in some implementations, a sensor is provided on each of the trays of the multi-function device. In such implementations, the frame to which the feeder unit is attached includes a projection (also, called a sheet metal flag) detectable by the sensor, such that the sensor on each of the trays is able to sense the position and movement of the feeder unit relative to that tray, based on the detection of the projection.

Furthermore, in some implementations, the multi-function device includes multiple sensors such that a sensor is provided on the feeder unit as well as a sensor is provided on each of the trays of the multi-function device. In such implementations, the multiple sensors together sense the position and movement of the feeder unit relative to the trays. For example, a signal/beam is passed by the sensor located on the feeder unit and a signal is passed by a sensor located on the tray such as tray 2. When the signal from both the sensors matches, the feeder unit stops at the tray 2.

Initially, a user submits a document for printing via his computing device such as a laptop, a computing device, a mobile device, or the like. Specifically, the user submits the document for printing through a print driver running on his computing device. While submitting the document for printing, the user submits one or more print attributes such as single-side/double-side, color/black&white, orientation, number of pages, media details such as media type, media size, media color, tray for printing, or the like. This way, the user successfully submits the document for printing at the multi-function device and a print request at the multi-function device.

In function, the multi-function device 800, specifically, the controller 802 receives the document and the print attributes as submitted by the user. This way, the controller 802 receives the print request including the document and the media details such as media type, media size, or media color. Upon receiving the document and the relevant details from the user, the controller 802 adds the document for printing in a print queue at the multi-function device. According to the print queue, the controller 802 starts executing the document. At the time of executing, the controller 802 identifies a tray required for printing the document i.e., target tray. The controller 802 identifies the target tray of the plurality of trays to be used for printing the document, based on the request. The target tray identification can be done based on the details included in the print request. For example, the controller 802 identifies the tray based on the media type, media size. For example, if the user selects the media type such as A4 media sheets, then the controller 802 identifies the tray having A4 media sheets. In another example, if the user selects the media type as A3 media sheets, then the controller 802 identifies the tray having A3 media sheets. In further example, if the user selects the tray ID/number, the controller 802 identifies the tray for printing the document of the user. This way, the controller 802 identifies the target tray to be used for printing the document.

Once identified, the controller 802 checks for a current position of the feeder unit. The sensor located on the feeder unit senses the position of the feeder unit and passes the current position and sends the same to the controller 802. In this example, the sensor 810 is coupled to the first motor. The sensor 810 detects the position of the single moveable feeder unit 402. For example, the sensor 810 detects: the current position of the single moveable feeder unit 402 and a movement of the single moveable feeder unit 402. Based on the current position, the controller 802 further proceeds forward. For example, if the current position of the feeder unit 402 is at the target tray, the method proceeds with printing the document of the user. But if the current position of the feeder unit 402 is different from the target tray such as default tray such as tray 1, the controller 802 moves the feeder unit 402 to the tray 3. The controller 802 moves the feeder unit 402 from the current position of the feeder to the position proximate the target tray for retrieving one or more media sheets from the target tray. Here, the current position can be any position different from the target tray, for example default tray such as tray 1, tray 2, tray 4 and so on. The single moveable feeder unit 402 is located at a position proximate to a tray used for printing document previously present in the print queue or from where one or more media sheet is last retrieved.

The multi-function device 800 further include the at least one track 406. In the current implementation, the multi-function device includes the two tracks 406*a*, 406*b* which are oriented along the substantially vertical axis. The single moveable feeder unit 402 engages with the two tracks 406*a*, 406*b* and moves across the plurality of positions along the two tracks 406*a*, 406*b*.

Based on the position sensing, the controller 802 sends a signal to the feeder unit to reposition the single moveable feeder unit 402 to a position proximate to the target tray. The sensor 810 provides the signal to the first motor 410 of the drive system to start or stop causing movement of the single moveable feeder unit 402 along the lead screw 408 to reposition the single moveable feeder unit 402, proximate to the target tray. The lead screw 408 may be attached to the multi-function device 800 and oriented parallel to the substantially vertical axis. Further, the engaging member may be attached to the single moveable feeder unit 402 and configured to engage with the lead screw 408. The first motor 410 may be attached to the single moveable feeder unit 402 and coupled to the engaging member. Further, the first motor 410 may be configured to rotate the engaging member to thereby cause movement of the engaging member and the single moveable feeder unit 402 along the lead screw 408. Therefore, the signal may trigger the first motor to start rotating to thereby move the single moveable feeder unit 402 to reposition the single moveable feeder unit 402 to a position proximate to the target tray.

The single moveable feeder unit 402 may further include the folding feed roller 412 configurable between the feed position and the un-feed position, one or more shafts, and one or more guides. For example, the folding feed roller 412 may be configurable between the feed position and the un-feed position by pivotably rotating about the horizontal axis A-A' parallel to the length of the single moveable feeder unit 402. In the feed position, the folding feed roller 412 may be aligned proximate to the media sheet stack 414 to contact the media sheet stack 414, and in the un-feed position, the folding feed roller 412 may be aligned away from the media sheet stack 414. Further, in some embodiments, the folding feed roller 412 may be powered by the solenoid 808 to pivotably rotate about the horizontal axis A-A'.

Upon receiving the signal, the single moveable feeder unit 402 moves across the plurality of positions to reposition itself proximate to the target tray. Upon repositioning, the single moveable feeder unit 402 retrieves one or more media sheets from the target tray. When the feeder unit 402 is moving across the plurality of positions, the folding feed roller 412 is configured in the un-feed position, such that folding feed roller 412 is aligned away from the media sheet stack 414. Once the single moveable feeder unit 402 is at a desired position proximate to the target tray from where the media sheet is to be retrieved, the folding feed roller 412 is configured into the feed position, to remove the top media sheet 414*a* from the media sheet stack 414 present in the tray. Then, one or more rollers of the folding feed roller 412 contact the top media sheet 414*a* of the media sheet stack 414. Upon contacting, the one or more rollers rotate to pull and remove the top media sheet 414*a* from the media sheet stack 414. To be configured in the feed position of FIG. 5B from the un-feed position of FIG. 5A, the folding feed roller 412 pivotably rotates about the horizontal axis A-A'. Further, once the retrieving of the media sheet(s) 414*a* is complete and the single moveable feeder unit 402 is required to travel to a different position proximate to a different tray, the folding feed roller 412 once again is to be configured in the un-feed position. The folding feed roller 412 is caused to pivotably rotate about the horizontal axis A-A' to reconfigure into the un-feed position. It should be noted that once the retrieving of the media sheet is complete and the single moveable feeder unit 402 is required to travel to a different position, the folding feed roller 412 is configured into the un-feed position, before the single moveable feeder unit 402 starts travelling to a different position. The un-feed position of the folding feed roller 412 allows the single moveable feeder unit 402 to travel across the plurality of positions without any obstructions.

This way, the one or more media sheets from the target tray are retrieved for printing. The retrieved sheets as passed to the print engine for printing the document resulting a print output.

Upon retrieving the one or more media sheets from the target tray, the single moveable feeder unit 402 returns to a pre-defined position proximate to a pre-defined tray of the plurality of trays 404.

To avoid any interference of the feeder unit 402 with the trays while moving up and down, the movable feeder unit 402 is provided with an initial folding feed roller. The folding feed roller is activated by solenoid to rotate and pick up the paper. This folding feed roller is at an angled/rotated position while travelling vertically otherwise folding feed roller is in a flat position to pick up the paper and sending picked paper to the print engine for the print operation.

In the case of paper jammed situation, the controller 802 activates the paper jam clearing mechanism. As discussed above, the paper jam clearance mechanism includes an inbuilt blade and two rods, one is a guide rod and another one is threaded rod. When the controller 802 detects the paper jam, the motor is activated to rotate the threaded rod so that the inbuilt blade travels from machine inboard to outboard to cut the paper and allow the user to remove the paper manually without disturbing other parts. Finally, after tearing the paper the blade rests to its original position.

In detail, the blade 604 is configured to travel along the length of the single moveable feeder unit 402 to cut the media sheet 606 which may be jammed in the single moveable feeder unit 402. The two shafts including the drive shaft 608*a* and the threaded shaft 608*b* are aligned parallel to the length of the single moveable feeder unit 402. The blade 604 is threadably engaged with the threaded shaft 608*b*, and the blade travels along the threaded shaft 608*b* upon rotation of the threaded shaft 608*b* about its central axis. As the threaded shaft 608*b* rotates about its central axis, the blade 604 is caused to move along the threaded shaft 608*b*. The rotation of the threaded shaft 608*b* is powered by the second motor 610 mounted on and fixed to the single moveable feeder unit 402. The second motor 610 is communicatively coupled to the controller 802. Upon detection of the media sheet jamming, the controller 802 therefore trigger the second motor 610 to cause rotation of the threaded shaft 608*b* to further cause the blade 604 to move along the threaded shaft 608*b* and cut the jammed media sheet. A rotation of the second motor 610 and the threaded shaft 608*b* in one direction may cause movement of the blade 604 from the first end to the second end of the single moveable feeder unit 402, while a rotation of the second motor 610 and the threaded shaft 608*b* in an opposite direction may cause movement of the blade 604 from the second end to the first end of the single moveable feeder unit 402.

Figure 9:
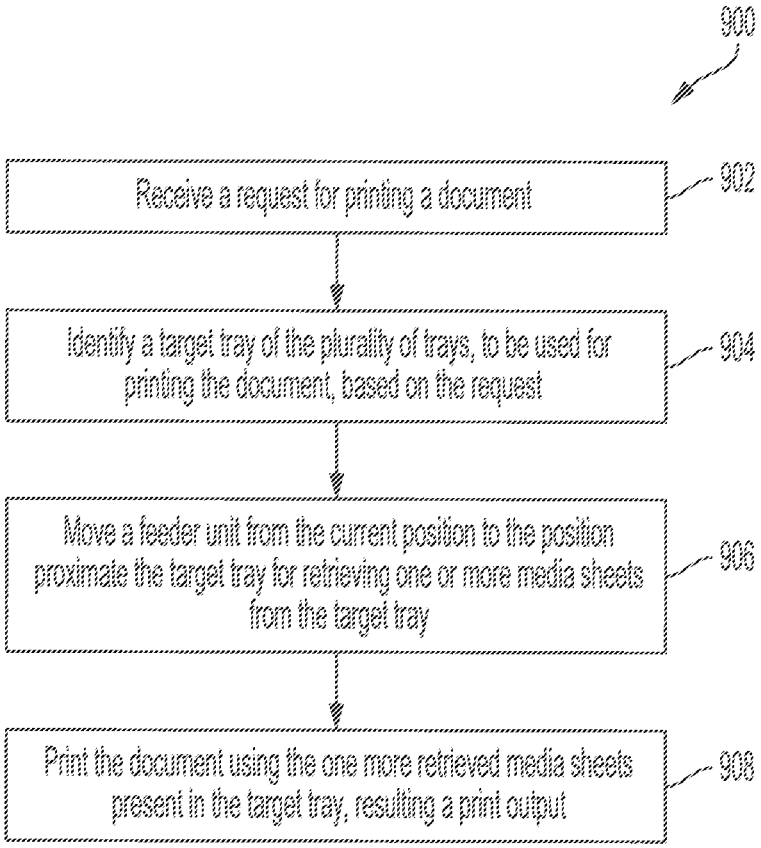
FIG. 9 is a flowchart of a method of retrieving media sheets from a plurality of trays using a single moveable feeder unit, in accordance with some embodiments of the present disclosure.

FIG. 9 is a method flow chart 900 for retrieving one or more media sheets from a target tray using a new feeder unit such as single moveable feeder unit. Specifically, FIG. 9 is a method 900 for moving the feeder unit across different positions of multiple trays at a multi-function device. The method 900 can be implemented at a multi-function device. But the method 900 can be implemented at a printer, a multi-function printer or any equivalent device with printing capabilities. The multi-function device includes a number of trays for printing and/or other imaging operation. The trays can have same media or different media without limiting the scope of the disclosure. Each tray 404 is positioned at a respective vertical height.

Initially, a user submits a document for printing along with one or more print attributes as discussed above. The print attributes include number of pages to be printed, custom print, orientation, multi-function device to be used for printing, color/black& white, single side/double size, finishing option, a media size, a media type, or a tray for printing the document.

At 902, a print request is received at the multi-function device for printing the document. Along with the document, the print request includes print attributes as discussed above. In case the print request does not include media details, the multi-function device considers default media type as A4 or default tray such as tray 1.

At 904, the target tray of the plurality of trays to be used for printing the document is identified. Once the target tray is identified, a position of the single moveable feeder unit 402 is detected. In some implementations, the position of the single moveable feeder unit 402 is detected using a sensor such as sensor 810 coupled to a motor such as first motor 410. The single moveable feeder unit 402 may be configured to move across a plurality of positions relative to the plurality of trays 404 and further configured to retrieve one or more media sheets from each of the plurality of trays 404. The single moveable feeder unit 402 may be configured to engage with at the least one track 406 and move across the plurality of positions along the at least one track 406. The at least one track 406 may be oriented along the substantially vertical axis. Based on the current position of the feeder unit 402, the method 900 proceeds forward. If the current position of the single feeder unit 402 is already at the target tray, the method 900 proceeds with printing the document. If the current position of the single feeder unit is different from the target tray, the method 900 proceeds forward.

At 906, the single feeder unit 402 is moved from the current position to a position proximate the target tray for retrieving one or more media sheets from the target tray. The method 900 includes checking if the single moveable feeder unit 402 associated with the plurality of trays is positioned proximate to the target tray. If it is detected that the single moveable feeder unit 402 is not positioned proximate to the target tray, the single moveable feeder unit 402 is caused to be moved from the current position to the position proximate the target tray. To move the feeder unit from the current position to the target tray, a signal is transmitted to the single moveable feeder unit 402 to reposition the single moveable feeder unit 402 at a position proximate to the target tray. Upon receiving the signal, the single moveable feeder unit 402 moves across the plurality of positions to reposition itself proximate to the target tray. Upon repositioning, one or more media sheets are retrieved from the target tray using the single moveable feeder unit 402. The single moveable feeder unit 402 may be caused to move across the plurality of positions by the drive system. For example, the drive system may include the lead screw 408 attached to the multi-function device 800 and oriented parallel to the substantially vertical axis. The drive system may further include the engaging member attached to the single moveable feeder unit 402 and configured to engage with the lead screw 408. The drive system may further include the first motor 410 attached to the single moveable feeder unit 402. The first motor 410 may be further coupled to the engaging member and configured to rotate the engaging member to thereby cause movement of the engaging member and the single moveable feeder unit 402 along the lead screw 408.

In order to retrieve one or more media sheets from the target tray, the folding feed roller 412 is configured from the un-feed position to the feed position by pivotably rotating the folding feed roller 412 about the horizontal axis A-A' parallel to the length of the single moveable feeder unit 402. In the feed position, the folding feed roller 412 is aligned proximate to the media sheet stack 414 to contact the media sheet stack 414 and final retrieve the media sheets. This way, the media sheets are retrieved from the target tray (by moving the feeder unit from the current position to the target), using the new feeder unit. In the un-feed position, the folding feed roller 412 may be aligned away from the media sheet stack 414. The folding feed roller 412 may be powered by the solenoid 808 to pivotably rotate about the horizontal axis.

At 908, the document is finally printed using the one or more retrieved media sheets present in the target tray, resulting a print output.

The method 900 additionally includes continuously sensing the position of the single moveable feeder unit while moving the single moveable feeder unit across the plurality of trays of the multi-function device.

In some additional embodiments, the method 900 includes implementation of paper jam clearance mechanism. The method 900 may include detection of a jamming situation of a media sheet in the single moveable feeder unit 402. It should be noted that the jamming situation of media sheet in the single moveable feeder unit 402 may be detected by a jamming sensor provided on the multi-function device 800. As such, the blade 604 may be caused to cut the media sheet. As already mentioned above, the blade 604 may be configured to cut media sheet by travelling along a length of the single moveable feeder unit 402. The length of the single moveable feeder unit 402 may be defined between the first end and the second end of the single moveable feeder unit 402 perpendicular to the vertical axis. The blade 604 travel along the threaded shaft 608*b* upon rotation of the threaded shaft 608*b* along its central axis. The blade 604 may be threadably engaged with the threaded shaft 608*b* which may be aligned parallel to the length of the single moveable feeder unit 402. The rotation of the threaded shaft 608*b* may be powered by the second motor 610.

A moveable single moveable feeder unit for a multi-function device and techniques for retrieving media sheets from a plurality of trays of the multi-function device are disclosed. A single moveable feeder unit is provided which is configured to retrieve media sheets from each of the plurality of trays, by moving across a plurality of positions to reposition itself proximate to a tray of the plurality of trays from where the media sheet is to be retrieved. By replacing multiple single moveable feeder units for each tray of the plurality of trays with a single moveable feeder unit, the cost and time of manufacture, operation, and repair are brought down. Moreover, a blade for cutting a jammed media sheet from the single moveable feeder unit provides for an effective yet economical solution of overcoming the problem of media sheet jamming in the multi-function device.

For a person skilled in the art, it is understood that the use of phrase(s) "is", "are", "may", "can", "could", "will", "should" or the like is for understanding various embodiments of the present disclosure and the phrases do not limit the disclosure or its implementation in any manner.

It is emphasized that the term "comprises" or "comprising" is used in this specification to specify the presence of stated features, integers, steps or components, but does not preclude the addition of one or more further features, integers, steps or components, or groups thereof.

The order in which the method is described is not intended to be construed as a limitation, and any number of the described method blocks can be combined in any order to implement the method or alternate methods. Additionally, individual blocks may be deleted from the method without departing from the spirit and scope of the subject matter described herein. Furthermore, the method can be implemented in any suitable hardware, software, firmware, or combination thereof. However, for ease of explanation, in the embodiments described below, the method may be considered to be implemented in the above-described system and/or the apparatus and/or any electronic device (not shown).

The above description does not provide specific details of manufacture or design of the various components. Those of skill in the art are familiar with such details, and unless departures from those techniques are set out, techniques, known, related art or later developed designs and materials should be employed. Those in the art are capable of choosing suitable manufacturing and design details.

Note that throughout the following discussion, numerous references may be made regarding servers, services, engines, modules, interfaces, portals, platforms, or other systems formed from computing devices. It should be appreciated that the use of such terms is deemed to represent one or more computing devices having at least one processor configured to or programmed to execute software instructions stored on a computer readable tangible, non-transitory medium or also referred to as a processor-readable medium. For example, a server can include one or more computers operating as a web server, database server, or other type of computer server in a manner to fulfill described roles, responsibilities, or functions. Within the context of this document, the disclosed devices or systems are also deemed to comprise computing devices having a processor and a non-transitory memory storing instructions executable by the processor that cause the device to control, manage, or otherwise manipulate the features of the devices or systems.

Some portions of the detailed description herein are presented in terms of algorithms and symbolic representations of operations on data bits performed by conventional computer components, including a central processing unit (CPU), memory storage devices for the CPU, and connected display devices. These algorithmic descriptions and representations are the means used by those skilled in the data processing arts to most effectively convey the substance of their work to others skilled in the art. An algorithm is generally perceived as a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be understood, however, that all of these and similar terms are to be associated with the appropriate physical quantities and are merely convenient labels applied to these quantities. Unless specifically stated otherwise, as apparent from the discussion herein, it is appreciated that throughout the description, discussions utilizing terms such as "receiving" or "retrieving", "printing", "detecting", or "identifying" or "sending" or "moving" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The exemplary embodiment also relates to an apparatus for performing the operations discussed herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general-purpose systems may be used with programs in accordance with the teachings herein, or it may prove convenient to construct more specialized apparatus to perform the methods described herein. The structure for a variety of these systems is apparent from the description above. In addition, the exemplary embodiment is not described with reference to any particular programming language. It will be appreciated that a variety of programming languages may be used to implement the teachings of the exemplary embodiment as described herein.

The methods illustrated throughout the specification, may be implemented in a computer program product that may be executed on a computer. The computer program product may comprise a non-transitory computer-readable recording medium on which a control program is recorded, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other tangible medium from which a computer can read and use.

Alternatively, the method may be implemented in transitory media, such as a transmittable carrier wave in which the control program is embodied as a data signal using transmission media, such as acoustic or light waves, such as those generated during radio wave and infrared data communications, and the like.

The terminology used herein is for the purpose of describing particular embodiments only and is not intended to be limiting of the disclosure. It will be appreciated that several of the above-disclosed and other features and functions, or alternatives thereof, may be combined into other systems or applications. Various presently unforeseen or unanticipated alternatives, modifications, variations, or improvements therein may subsequently be made by those skilled in the art without departing from the scope of the present disclosure as encompassed by the following claims.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A multi-function device, comprising:

a plurality of trays, wherein each of the plurality of trays is configured to store a media sheet stack, and wherein each of the plurality of trays is to be positioned at a respective vertical height;

a single moveable feeder unit, comprising:

the plurality of trays, configured to move from a current position to a position proximate a target tray for retrieving one or more media sheets from the target tray; and a blade for cutting a jammed media sheet during a jamming situation;

a controller; and a memory configured to store a plurality of instructions, wherein the plurality of instructions, upon execution by the controller, cause the controller to:

receive a request for printing a document, wherein the request comprising at least: a media size, a media type, and a tray, identify the target tray of the plurality of trays, to be used for printing the document, based on the request, move the single moveable feeder unit from the current position to the position proximate the target tray for retrieving one or more media sheets from the target tray, and print the document using the one or more retrieved media sheets present in the target tray, resulting print output.

2. The multi-function device of claim 1, wherein the controller is to receive the current position of the single moveable feeder unit.

3. The multi-function device of claim 1, wherein the single moveable feeder unit is configured to move across the plurality of trays at the multi-function device.

4. The multi-function device of claim 1, wherein the single moveable feeder unit comprises a sensor for sensing at least: the current position of the single moveable feeder unit and a movement of the single moveable feeder unit.

5. The multi-function device of claim 1, wherein the single moveable feeder unit comprises a print engine in communication with the single moveable feeder unit for receiving the one or more retrieved media sheets for printing content of the document.

6. The multi-function device of claim 1, wherein the single moveable feeder unit comprises at least a folding feeder roller, one or more shafts, a drive mechanism, one or more motors, and one or more guides.

7. The multi-function device of claim 1, wherein, upon retrieving the one or more media sheets from the target tray, the single moveable feeder unit is to return to a pre-defined position proximate to a pre-defined tray of the plurality of trays.

8. A multi-function device, comprising:

a plurality of trays, wherein each of the plurality of trays is configured to store a media sheet stack, and wherein each of the plurality of trays is to be positioned at a respective vertical height;

a single moveable feeder unit for the plurality of trays, configured to move from a current position to a position proximate a target tray for retrieving one or more media sheets from the target tray, and wherein the single moveable feeder unit comprises a blade for cutting a jammed media sheet during a jamming situation;

a controller; and a memory configured to store a plurality of instructions, wherein the plurality of instructions, upon execution by the controller, cause the controller to:

receive a request for printing a document, wherein the request comprising at least: a media size, a media type, and a tray, identify the target tray of the plurality of trays, to be used for printing the document, based on the request, move the single moveable feeder unit from the current position to the position proximate the target tray for retrieving one or more media sheets from the target tray, and print the document using the one or more retrieved media sheets present in the target tray, resulting print output.

9. The multi-function device of claim 8, wherein the controller is to receive the current position of the single moveable feeder unit.

10. The multi-function device of claim 8, wherein the single moveable feeder unit is configured to move across the plurality of trays at the multi-function device.

11. The multi-function device of claim 8, wherein the single moveable feeder unit comprises a sensor for sensing at least: the current position of the single moveable feeder unit and a movement of the single moveable feeder unit.

12. The multi-function device of claim 8, wherein the single moveable feeder unit comprises a print engine in communication with the single moveable feeder unit for receiving the one or more retrieved media sheets for printing content of the document.

13. The multi-function device of claim 8, wherein the single moveable feeder unit comprises at least a folding feeder roller, one or more shafts, a drive mechanism, one or more motors, and one or more guides.

14. The multi-function device of claim 8, wherein, upon retrieving the one or more media sheets from the target tray, the single moveable feeder unit is to return to a pre-defined position proximate to a pre-defined tray of the plurality of trays.

* * * * *